US005336140A

United States Patent [19]

LeBlond

[11] Patent Number: 5,336,140

[45] Date of Patent: Aug. 9, 1994

[54] HAND GRIP EXERCISER

[76] Inventor: Claude LeBlond, P.O. Box 565, Broad Brook, Conn. 06016

[21] Appl. No.: 888,405

[22] Filed: May 21, 1992

[51] Int. Cl.[5] ..... A63B 23/16

[52] U.S. Cl. ..... 482/49; 482/112

[58] Field of Search ..... 482/49, 111, 112

[56] References Cited

U.S. PATENT DOCUMENTS

| | | | |
|---|---|---|---|
| 3,834,696 | 9/1974 | Spector | 482/112 |
| 4,222,560 | 9/1980 | Hallerman . | |
| 4,429,871 | 2/1984 | Flechner | 482/112 |
| 4,530,496 | 7/1985 | Smith et al. . | |
| 4,553,746 | 11/1985 | Lee | 482/49 |
| 4,558,864 | 12/1985 | Medwedeff . | |
| 4,623,141 | 11/1986 | Salvino . | |
| 4,753,434 | 6/1988 | Salvino . | |
| 4,801,139 | 1/1989 | Vanhoutte et al. | 482/112 |
| 4,856,498 | 8/1989 | Osbon . | |
| 4,869,492 | 9/1989 | Joutras . | |
| 4,944,508 | 7/1990 | Collins | 482/112 |

OTHER PUBLICATIONS

Marcy Pro Wedge Advertisement, date of first Pub. 1989.

*Primary Examiner*—Richard J. Apley
*Assistant Examiner*—Lynne A. Reichard
*Attorney, Agent, or Firm*—McCormick, Paulding & Huber

[57] ABSTRACT

A gripper employs a hydraulic linear decelerator as a resistance device and includes first and second parts that are movable relative to one another and act against the linear decelerator when moved between a first position and a second position thereby causing the decelerator to provide resistance to such movement and create a desired exercise effect to the user.

3 Claims, 4 Drawing Sheets

HAND GRIP EXERCISER

BACKGROUND OF THE INVENTION

This invention relates to exercise equipment and in particular to a type of such equipment which is capable of being gripped by a user and subsequently squeezed in succession to effect a desired conditioning of the muscles involved in squeezing of the device by providing a nonvarying means of resistance.

In the hand exercise equipment field, it is known to use an exerciser that is in essence a gripper which employs a torsion spring to generate a desired resistance against which the operator exercises. An example of such an arrangement is disclosed in U.S. Pat. No. 4,623,141 issued to Salvino on Nov. 18, 1986 and entitled HAND HELD ARM AND HAND MUSCLE BUILDER. In this patent, it is disclosed to employ a coiled spring the ends thereof being integrally and respectively formed with handles each of which is in turn shaped to readily conform to the users grip. However, a number of drawbacks are associated with using hand grippers of this type. The first of these is that the resistant force (F) is not a constant force, but is one related to displacement as defined by the following equation:

$$F=KX,$$

wherein, K is the spring constant and X is the deflection of the spring measured from a given at rest position.

Thus, is it apparent that with the increase of deflection of the spring, the resistant force linearly increases. This results in the uneven exercising of muscles used by the hand during a work out because in the muscle building process the smaller fingers which are not sufficiently strong to counter the linearly increasing force generated by the spring do not work, but defer to the larger more strong muscles in the involved hand. Thus, all the muscles in every finger of the hand being exercised are not exercised evenly or continuously thereby resulting in the loss of the effectiveness of the exercise equipment.

It is therefore an object of the present invention to provide a hand exerciser wherein the exerciser includes means for presenting a nonvarying resistance force to the user when squeezing it.

A further object of the present invention is to provide a gripper of the aforementioned type which is compact and self-contained while nevertheless providing the desired uniform resistance force.

Other objects and advantages of the invention will become apparent from the following description and the appended claims.

BRIEF DESCRIPTION OF THE PREFERRED EMBODIMENTS

Figure 7:
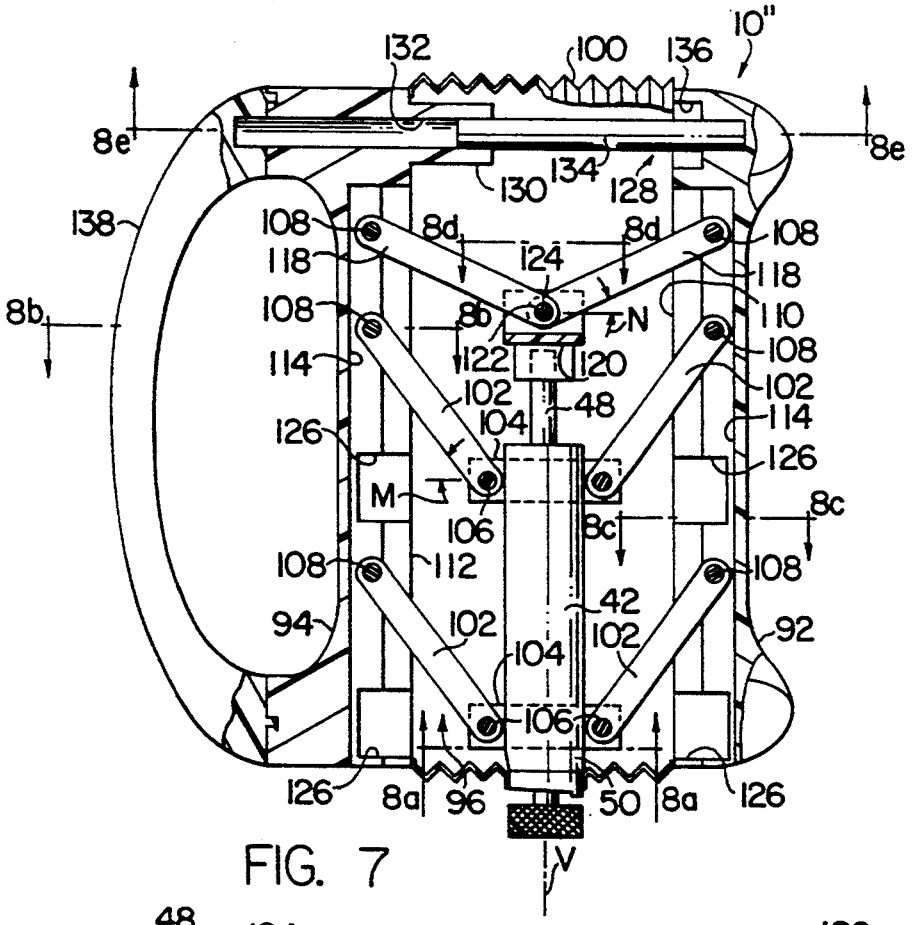
FIG. 7 is a partially fragmentary side elevation view of a third embodiment of the gripper.
Figure 8A:
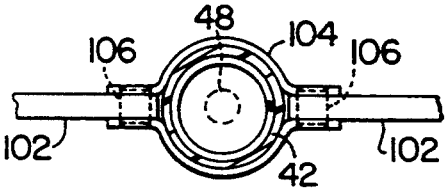

FIG. 8*a* is a sectional view taken along line 8*a*—8*a* in FIG. 7.

Figure 8B:
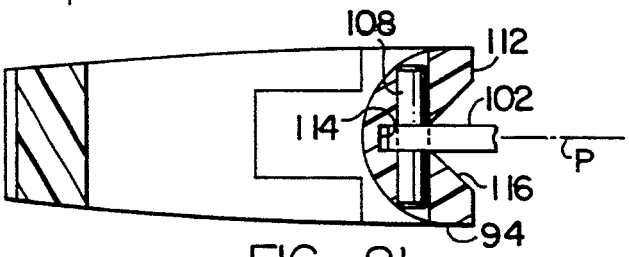

FIG. 8*b* is a sectional view taken along line 8*b*—8*b* of FIG. 7.

Figure 8C:
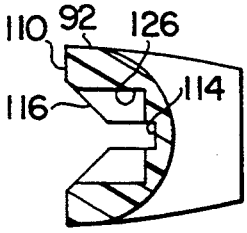

FIG. 8*c* is a sectional view taken along line 8*c*—8*c* of FIG. 7.

Figure 8D:
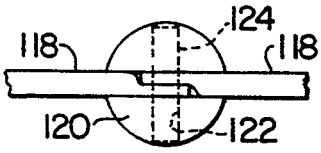

FIG. 8*d* is a partially fragmentary view taken along line 8*d*—8*d* in FIG. 7

Figure 8E:
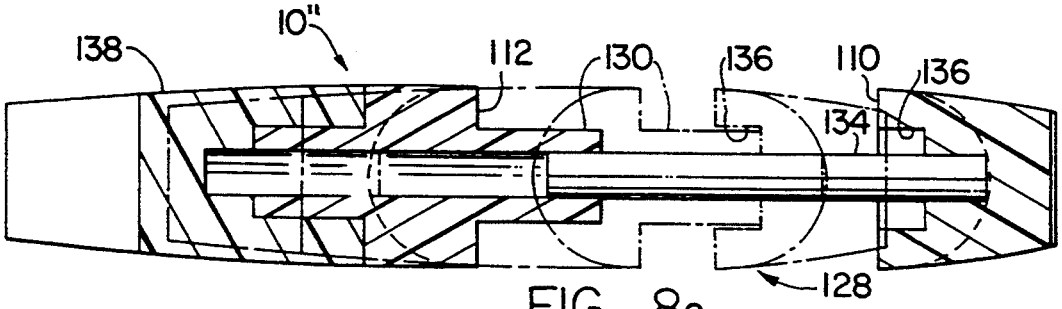

FIG. 8*e* is a horizontal sectional view taken along line 8*e*—8*e* of FIG. 7.

Figure 4:
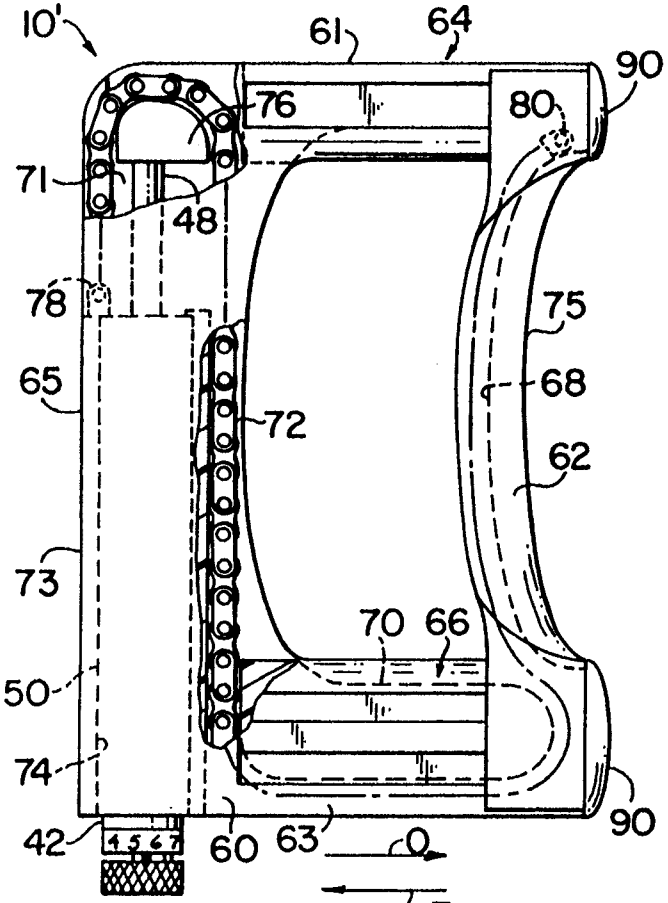
FIG. 4 is a partially fragmentary side elevation view of a second embodiment of the gripper with portions thereof cut away to reveal the operating mechanism.
Figure 9:
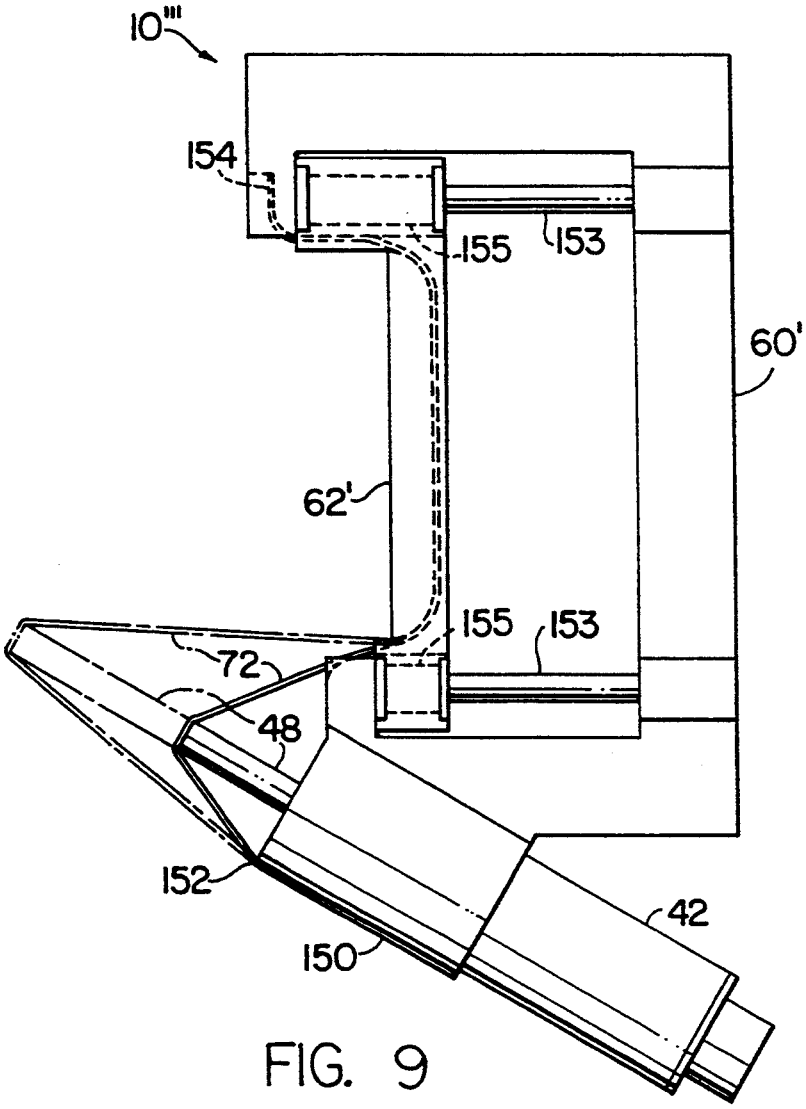

FIG. 9 is a side elevational view of a fourth embodiment of the gripper shown in FIG. 4.

DETAILED DESCRIPTION OF THE PREFERRED EMBODIMENT

Figures 1, 2, 3:
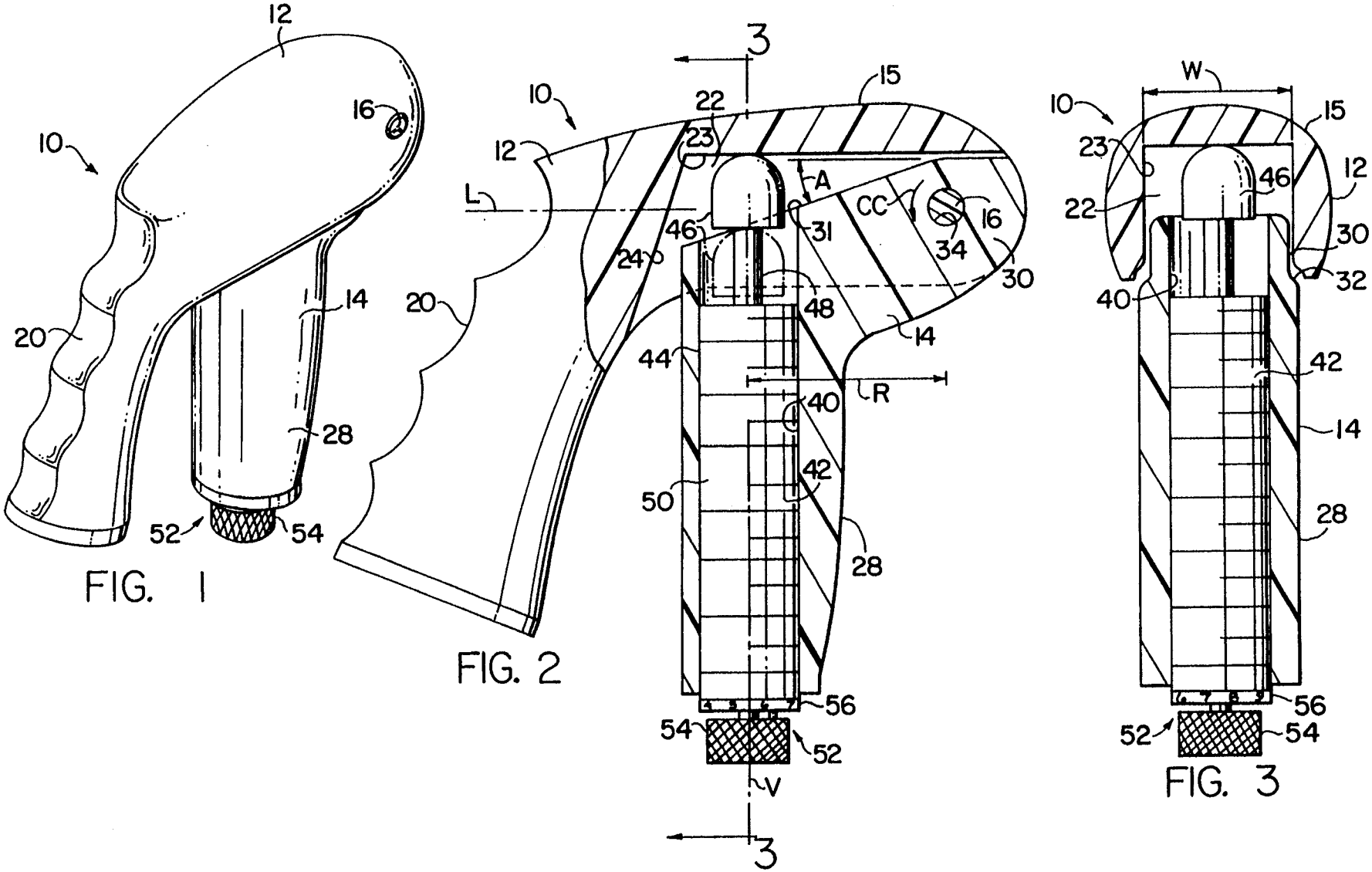
FIG. 1 is a perspective view of the embodiment of the gripper embodying the present invention.
FIG. 2 is a partially fragmentary side elevation view of the gripper of FIG. 1 showing the internal components of the device.
FIG. 3 is a vertical section taken through the gripper of FIG. 2 along line 3—3.

In FIGS. 1–3 a self-contained gripper identified as 10 embodies the invention. The gripper 10 is comprised of a first holding part 12 having a major axis L and a second holding part 14 having a minor axis V attached for pivotable movement relative to one another through the intermediary of a pivot pin 16. The first holding part has a body portion 15 extending along the major axis L at its front end and includes gripping means 20 having a ridge-like profile allowing the front end of the first holding part to be grasped along this length by the fingers of a user. At the end of the first holding part 12 opposite the gripping means 20 is provided a slot 22 extending inwardly from the back end thereof along an abutment surface 23 and ending in an end wall 24 extending substantially perpendicularly to the major axis L. The slot 22 having a width W bifurcates the body portion 15 to define a generally U-shaped cavity extending parallel to the major axis L. The second holding part 14 is comprised of a substantially cylindrical base portion 28 and a flat plate-like portion 30 integrally formed therewith suitably sized and configured to be received within the slot 22 formed in the body portion 15 of the part 12. The base portion 28 and the associated plate member 30 are integrally formed with one another and are so connected through the intermediary of a transition portion 32 as to permit the substantially cylindrical base portion 28 to have a greater dimension diametrically speaking taken relative to the width W of the slot 22, while nevertheless permitting the plate member 30 to be correspondingly sized to be received within the bifurcated region of the first holding part 12.

The flat plate-like portion 30 of the second holding part 14 is journalled about the pivot pin 16 through the intermediary of an opening 34 which receives the pin 16. The leading end surface of the plate member 30 is sloped forming a shoulder 31 having an angle A equalling approximately 30 degrees relative to the major axis L of the first holding part 12. This taper is important in that it permits the relative arcuate movement between the first and second holding parts 12 and 14 respectively to be achieved by providing an appropriate clearance. An opening 40 is provided in the substantially cylindrical base portion 28 of the second holding part 14 and extends generally coincidentally with the minor axis V of the second holding part 14. Received within the opening 40 is a hydraulic linear decelerator 42 having an endpiece or pad 46 connected for reciprocating motion to the decelerator 42 through the intermediary of a sliding piston rod 48. The decelerator 42 is secured against movement by any means that is capable of accomplishing this, which in the preferred embodiment is constituted by the outwardly exposed surface 44 of the decelerator 42 being provided with a continuous helical thread correspondingly sized diametrically and pitchwise to like threads formed in the internal surface of the opening 40.

The hydraulic decelerator 42 is one of the type that is commercially available having an internal spring which normally biases the rod 48 outwardly of the housing 50. This spring return is selected to be sufficiently strong to return the first and second holding parts 12 and 14 to their normally spaced apart condition as shown in FIGS. 1 and 2. Notwithstanding, the internal spring offers only negligible resistance in compression taken relative to the primary resistance provided by the hydraulic fluid and sliding piston system of the decelerator. The hydraulic decelerator 42 may be one that is commercially sold by Ace Controls, Inc. of Farmington, Mich. or ENIDINE, Inc. of Orchard Park, N.Y., and which linear decelerator has a stroke of approximately 1" and a maximum work potential for each cycle of about 12,000 inch-pounds per hour. The decelerator 42 in the preferred embodiment is of the type which also includes a resistance regulator 52 which is set by manipulating a rotatable dial 54 allowing the user to adjust the resistance by graduations 56 formed about the lower circumferential end of the cylinder housing 50.

The endpiece 46 is normally outwardly biased towards the abutment surface 23 and is drawn against it when the holding parts 12 and 14 are squeezed, but which relative movement is arrested through the intermediary of the shoulder 31 engaging the abutment surface 23. That is, the endpiece 46 acts along a line of action coincident with the minor axis V, which is itself spaced from the center of rotation at the pin 16 by a distance R which creates a moment in the counterclockwise direction CC. The endpiece 46 when oriented as shown in FIG. 2, is in its outermost extended position and is engaged by the abutment surface 23. From this initial orientation, continued squeezing action drives the endpiece 46 downwardly an inwardly into the opening 40 against the hydraulic resistance provided in the linear decelerator until the shoulder 31 and the abutment surface 23 coengage. At this point the user releases his or her grip allowing the counterrotating action CC generated by the internal spring recoil of the decelerator 2 to return the first and second holding parts 12 and 14 to their normally spaced apart relationship as shown in FIGS. 1 and 2.

Figure 6:
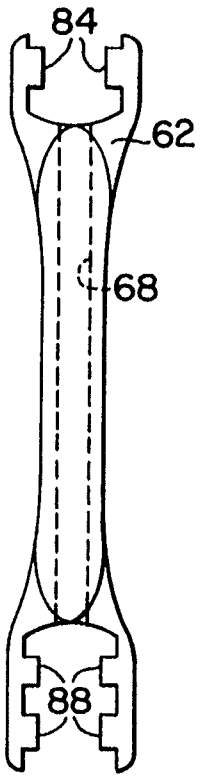
FIG. 6 is a front elevation view of the sliding reciprocating part shown apart from the gripper of FIG. 4.
Figure 5:
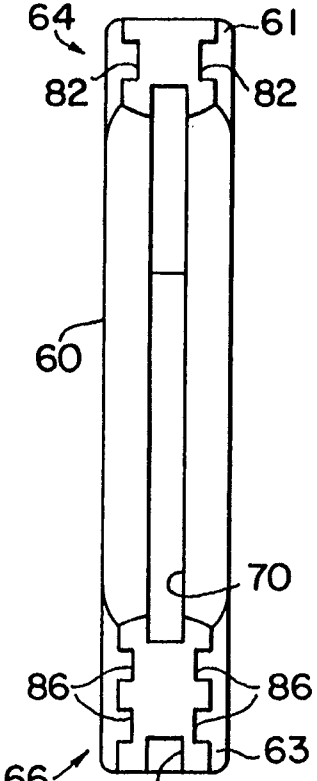
FIG. 5 is a front elevation view of the gripper of FIG. 4 shown absent its sliding reciprocating part.

Turning now to FIG. 4–6, and in particular to the second embodiment of the gripper 10', it should be seen that the gripper herein shown includes a generally U-shaped base part 60, a sliding part 62 and guide means 64 and 66 disposed between the base and sliding parts for guiding the sliding part 62 for reciprocating movement on the U-shaped base part 60. The U-shape base part is defined by first and second extension portions 61 and 63 interconnected by a transverse portion 65. The base part 60 is a generally hollow member having an internal chamber 71 disposed therein and sized accordingly for permitting articulation of the internal component parts of the gripper 10' as will hereinafter become apparent. The gripper 10' further includes a first track portion 68 associated with the sliding part 62 and a second track portion 70 associated with the base part 60 through which is disposed a means 72 for drivingly interconnecting the base part 60 with the sliding part 62. The sliding part 62 has a smooth curved gripping surface 75 which is readily conformable to be grasped by the forefingers of the user while in a similar manner the transverse portion 65 of the U-shaped base part 60 has a similar curved back surface 73 allowing it to be comfortably grasped in the palm of the hand which is being exercised. A threaded opening 74 is provided in the transverse portion 65 of the base 60 and extends generally parallel with its elongate extent. Disposed within the opening 74 is a hydraulic decelerator 42 having a reciprocating rod 48 and a guide cap 76 for coacting with the interconnecting means 72. The guide cap 76 has a track or guide formed in its outer face for receiving the means 72 therein and for directing it along a given path. As shown in FIG. 4, the means 72 is a chain segment having links sufficiently short to enable it to follow a desired path through the gripper 10'. The chain 72 has a first end 78 fixed to the transverse portion 65 of the base 60 and a second end 80 fixed to one end of the sliding part 62 such that the chain follows a double loop path through the gripper 10'. It should be appreciated here that the track 68 is disposed internally of the outwardly disposed surface 75 of the sliding part 62 thereby preventing its interference with the user. In a similar manner, the track 70 and the route followed by the chain through the U-shaped base part 60 is enclosed by the outer housing of this part thereby insuring the users protection against injury.

As seen in FIGS. 5 and 6, the guide means 64 and 66 associated with each of the extension portions 61 and 63, and with each distil end of the sliding part 62 are comprised, in this embodiment, of a first recess pair 82,82 formed in the first extension portion 61 correspondingly sized and shaped to receive the inwardly directed profiles of projections 84,84 formed on one end of the sliding part 62. Likewise, the second guide means 66 includes two sets of recesses 86,86 formed in the extension portion 63 of the U-shaped base part 60 and which recesses being correspondingly sized and shaped to receive the inwardly directed profiles of projections 88,88 disposed at the other end of the sliding part 62.

In operation, the internal spring recoil of the linear decelerator 42 causes the chain 72 to be held slightly in tension so that it does not extend limply between points of engagement. For securing the sliding part 62 against separation from the base part 60 due to this slight tensioning of the chain 72 in the normal at rest state of the gripper 10'end caps 90,90 are secured to the end faces of the extension portions 61 and 63 and provide a stop against which the sliding part normally rests. In this manner, the sliding part 62 being normally outwardly biased in the 0 direction by the decelerator 42 is caused to move in the direction E when squeezed thereby drawing the chain 72 against the guide cap 76 and thus causing the rod 48 to be moved inwardly toward the cylinder housing 50 to thereby provide the desired resistance to the motion applied. When a desired travel limit is reached in the E direction, the user releases the sliding part 62 allowing the internal spring of the decelerator 42 to act against the chain 72 and return the sliding part in the 0 direction to its normally outwardly disposed position thereby ending one cycle.

In FIGS. 7, **8*a*—8*e*, a third alternative embodiment of the gripper 10" is shown. In this embodiment the gripper 10" is comprised of two holding parts 92 and 94 interconnected to one another by a link means 96 associated with these parts and with a linear decelerator 42 nested between the holding parts through the intermediary of the link means 96. As is the case in the previous examples, the outward surfaces of each of the holding parts 92 and 94 is curved to allow the user to comfortably grip the first holding part 92 against the palm of the involved hand while the second holding part 94 is grasped by the extended fingers. The gripper 10'' further includes a bellows type cover member 100 which protects the user from being injured by the articulated nested parts of the link means 96** during exercising.

The link means 96 includes two pairs of support links 102,102, preferably steel, secured to the linear decelerator 42 through the intermediary of collar members 104,104. The collar members 104,104 are threadily connected to the outer surface 44 of the decelerator 42 or may alternatively be attached to the deceleration in a known manner, such as by adhesive bonding. Each support link pair 102,102 is pivotally connected to its respective collar member through the intermediary of headed pivot pins 106,106. The collar members 104,104 which secure the inwardly directed ends of the links 102,102 are of two piece construction as best seen in FIG. 8*a* and are maintained in substantial circumferential engagement about the decelerator 42 by the pins 106,106. The opposite outwardly directed ends of each link pair 102,102 are pivotally connected to each holder part 92 and 94 by pivot pins 108,108. As best shown in FIGS. 8*b* and 8*c*, the inwardly directed faces 110 and 112 of the first and second holder parts 92 and 94 include a longitudinally extending slot 114,114. Disposed intermediately of the inwardly directed faces 110 and 112 of each of the holder parts 92 and 94 and each slot 114 has a V-shaped groove 116,116 communicating with the associated slot and tapering outwardly therefrom and ending in a corresponding one of the faces 110 and 112. As will hereinafter become apparent, the grooves 116,116 assist seating of the links 102,102 during the compression stroke.

The link means 96 further includes a pair of force transmission links 118,118 which are pivotally connected at the outwardly directed ends thereof to the respective ones of the first and second holder parts 92, 94 in a manner identical to that provided for the links 102,102. The links 118,118 at their inwardly disposed ends are pivotally connected to the guide cap 120 fixed to the outwardly disposed end of the sliding piston rod 48. As best shown in FIG. 8*d* the guide cap 120 is bifurcated diametrically and coincident with a plane P that includes each of the slots 114,114 formed in the holder parts 92 and 94. An opening 122 is formed in the cap 120 and extends orthogonally to this plane and intersects the line of action V of the decelerator 42. The ends of the links 118,118 are juxtaposed relative to the cap 120 are pivotally connected to it through the intermediary of a connecting pin 124 received within the transverse opening 122. The links 102,102 and 118,118 are substantially rectangular in cross-section further assisting nesting within the plane P by virtue of this shape. To provide for maximum stroke length for the given gripper 10'' cutouts 126,126 are formed in each of the first and second holder parts 92 and 94. The cutouts 126,126 are positioned coincident with the location of each of the collar members 104,104 such that upon movement of the first holder part relative to the second holder part the outwardly extending portions of the collar members are received within each cutout thereby providing for the maximum possible closing action.

As is best seen in FIGS. 7 and 8*e*, a linear guide means 128 is provided at one end of the gripper 10'' which assists in confining movement of the first and second holding parts 92 and 94 to the plane P. To this end, the means 128 includes an extension portion 130 having an opening 132 formed internally thereof, and being appropriately sized and configured to receive a sliding shaft 134 secured at one end to the first holding part 92. Located directly oppositely of the extension 130 on the holding part 92 is a further cutout 136 correspondingly sized and shaped to receive a portion of the extension 130 in a manner similar to that disclosed with reference to the cutouts 126,126 and the collar members 104,104. In this way, a user may squeeze the gripper 10' between the first and second holding members 92 and 94 causing a resultant force to be directed along links 118,118 to depress the guide cap 120 against the otherwise relative stationary position of the decelerator cylindrical housing 50. That is, as assembled, the gripper 10'' has each pair of connecting links 102,102 oriented at a relatively steep angle M of approximately 60 degrees, whereas the pair of drive links 118,118 are each disposed at a second angle N equally approximately 30 degrees. This angular differential between the orientation of links 118,118 and that of links, 102,102 upon the drawing of holding parts 92 and 94 together, results in the guide cap 120 being driven downward against the otherwise stationary positioning of the housing cylinder 50.

It is a feature of the gripper 10'' to provide a detachable guard 138 which can be mounted to the second holding part 94, such as, by a key-hole slot and correspondingly projection. A number of guards 138 may be provided, each having a different weight, further making the gripper effective as a lifting piece and thus enhancing muscle tone in the arms during an exercise program.

From the foregoing, a gripper which employs a hydraulic resistance has been disclosed in the preferred embodiments. However, numerous modifications and substitutions may be had without departing from the spirit of the invention For example, in the gripper 10'' the links 102,102 that support the hydraulic member 42 may in fact be constituted by a single link pair with a second linear guide 128 being provided to enhance stability. Also, the location of the decelerator 42 on the gripper may be changed without affecting performance. For example, in the gripper 10''' shown in FIG. 9., the base part 60' may be a solid member and the decelerator 42 can be supported by a collar 150 integrally formed with it. The means 72, in this case takes the form of a high strength cable secured at one end 152 to the collar 150 and at its other end 154 to the base part 60'. As shown in phantom line, the cable is normally pushed outwardly of the gripper by the rod 48 when it is extended, but is pulled against the rod 48 when the sliding part 62' is squeezed by the user during exercising. Also, guide means 64 and 66 can alternatively take the form of bars 153,153 received within correspondingly sized journalling members 155,155 formed at opposite ends of the sliding part 62'.

Accordingly, the invention has been described by way of illustration rather than limitation.

I claim:

1. A self-contained hand exercise device comprising:

a first part and a second part;

means interconnecting said first and second parts to effect relative movement therebetween from a first initial position to a second final position, said first and second parts being configured such that each of said parts is capable of being readily gripped in the hand of a user;

resistance means acting between said first and said second parts for resisting relative movement between said first and second parts as they are caused to be moved from said initial first position toward said second final position, said resistance means including a hydraulic means for providing even nonvarying resistance to said relative movement as said first and second parts are moved relative to one another;

means for returning said first and second parts to said initial position;

said first part includes a generally U-shaped base part defined by two extension portions spaced part form one another by a transversely extending portion integrally connected therewith;

said second part being a sliding part;

guide means provided on each of said extension portions of said base part and on the distal ends of said sliding part for effecting relative linear sliding movement between said base part and said sliding part; and wherein said interconnecting means is a length of cable.

2. An exercise device as defined in claim 1 further characterized in that said base part and said sliding part each includes a track means for guiding and receiving an interconnecting member therebetween.

3. An exercise device as defined in claim 1 further characterized in that said guide means include two spaced bars carried on said first holding part and journalling means provided in said second holding part for slidingly receiving each of said bars.

* * * * *